US010368587B2

(12) United States Patent
Oliver

(10) Patent No.: US 10,368,587 B2
(45) Date of Patent: Aug. 6, 2019

(54) SEAMLESSLY TRANSITIONED, DOUBLE LAYER, DUAL FABRIC GARMENT

(71) Applicant: Lori Bundschuh Oliver, Atlanta, GA (US)

(72) Inventor: Lori Bundschuh Oliver, Atlanta, GA (US)

(73) Assignee: Lori Bundschuh Oliver, Atlanta, GA (US)

( * ) Notice: Subject to any disclaimer, the term of this patent is extended or adjusted under 35 U.S.C. 154(b) by 0 days.

(21) Appl. No.: 14/532,755

(22) Filed: Nov. 4, 2014

(65) Prior Publication Data

US 2016/0120248 A1 May 5, 2016

(51) Int. Cl.

| | |
|---|---|
| ***A41B 1/08*** | (2006.01) |
| ***A41B 9/00*** | (2006.01) |
| ***A41B 9/04*** | (2006.01) |
| ***A41B 9/06*** | (2006.01) |

(52) U.S. Cl.

CPC ..... *A41B 9/04* (2013.01); *A41B 1/08* (2013.01); *A41B 9/00* (2013.01); *A41B 9/004* (2013.01); *A41B 9/06* (2013.01); *A41B 2400/34* (2013.01); *A41B 2400/38* (2013.01); *A41B 2400/62* (2013.01)

(58) Field of Classification Search

CPC ..... A41D 31/02; A41B 9/001; A41B 9/04; A41B 9/08; A41B 9/02; A41B 11/14; A41B 2300/35; A41B 9/00; A41B 9/004; A41B 9/06; A41B 2400/34; A41B 2400/38; A41B 2400/62; D04B 1/243; D04B 1/246; D04B 1/102

USPC .... 66/22, 177, 171, 176; 450/115, 116, 117, 450/124, 100, 94; 2/69, 400, 227, 228

See application file for complete search history.

(56) References Cited

U.S. PATENT DOCUMENTS

| | | | | | |
|---|---|---|---|---|---|
| 1,691,790 | A | * | 11/1928 | Volker | A41B 9/08 2/71 |
| 2,000,073 | A | * | 5/1935 | Goas | A41B 9/001 2/407 |
| 2,285,012 | A | * | 6/1942 | Burkey | D04B 1/243 2/402 |
| 3,678,514 | A | * | 7/1972 | Safrit | A41B 9/08 2/212 |
| 3,956,909 | A | * | 5/1976 | Negri | D04B 1/243 66/177 |
| 4,048,818 | A | * | 9/1977 | Cueman | D04B 1/265 66/172 E |
| 4,068,320 | A | * | 1/1978 | Machacek | A41D 1/06 2/227 |
| 5,052,058 | A | * | 10/1991 | Mueller | A41B 9/001 2/228 |
| 5,553,468 | A | * | 9/1996 | Osborne | A41C 3/0014 2/73 |

(Continued)

FOREIGN PATENT DOCUMENTS

EP 1937094 B1 1/2010

*Primary Examiner* — Jameson D Collier
*Assistant Examiner* — Heather N Mangine
(74) *Attorney, Agent, or Firm* — Dentons US LLP

(57) ABSTRACT

A double layer garment including a first inner layer, worn next to the skin, that is at least in part made of a natural fiber (e.g., cotton) and a second outer layer that is made of a synthetic fiber (e.g., spandex). The natural fiber inner layer and the synthetic fiber outer layer are seamlessly knitted together without seams to form the two layers.

23 Claims, 6 Drawing Sheets

(56) References Cited

U.S. PATENT DOCUMENTS 5,590,548 A * 1/1997 Osborne ..... A41B 9/04 2/401
5,613,378 A * 3/1997 Popa ..... A41D 1/06 2/213
5,855,123 A * 1/1999 Albright ..... A41B 9/04 66/177
6,125,664 A * 10/2000 Browder, Jr. ..... A41C 3/0014 450/92
6,145,132 A * 11/2000 Towner ..... A41B 9/02 2/400
6,192,717 B1 * 2/2001 Rabinowicz ..... D04B 1/243 66/171
6,276,175 B1 * 8/2001 Browder, Jr. ..... A41B 9/001 2/409
6,287,168 B1 * 9/2001 Rabinowicz ..... A41C 3/0007 450/156
6,287,169 B1 * 9/2001 Willms ..... A41B 9/001 2/400
6,550,288 B2 * 4/2003 Browder, Jr. ..... D04B 1/243 66/177
6,708,530 B2 * 3/2004 Mitchell ..... A41C 3/0014 66/176
6,886,367 B2 * 5/2005 Mitchell ..... A41C 3/0014 66/176
6,918,140 B1 * 7/2005 Cooper ..... A41D 1/084 2/228
7,024,892 B2 4/2006 Blakely
7,028,509 B2 * 4/2006 Mitchell ..... A41C 3/0014 66/176
7,260,961 B1 * 8/2007 Kennedy ..... D04B 1/243 66/171
7,395,557 B1 * 7/2008 Ledyard ..... A41B 9/06 2/113
7,546,751 B2 * 6/2009 Lutz ..... A41B 9/00 66/171
7,752,681 B2 * 7/2010 Michel ..... A41B 9/00 2/409
7,945,970 B2 * 5/2011 Belluye ..... A41D 13/0015 2/227
7,997,102 B2 * 8/2011 Obadalova ..... D04B 1/108 66/177
8,123,590 B2 * 2/2012 MacKinnon ..... A41B 11/003 2/228
8,172,782 B2 * 5/2012 Rock ..... A61F 13/06 2/69
8,721,388 B2 * 5/2014 Quaranta ..... A41B 9/06 450/69
8,919,347 B2 * 12/2014 Carlson ..... A61G 7/057 128/889
9,198,469 B2 * 12/2015 Clement ..... A41D 1/08
2002/0133865 A1 * 9/2002 Neman ..... A41B 9/08 2/170
2003/0196252 A1 * 10/2003 Blakely ..... A41B 11/005 2/400
2003/0230120 A1 * 12/2003 Mitchell ..... A41C 3/0014 66/171
2004/0014394 A1 * 1/2004 Mitchell ..... A41C 3/0014 450/65
2004/0065124 A1 * 4/2004 Israel ..... A41B 9/00 66/177
2004/0137821 A1 * 7/2004 Sandroussi ..... A41C 3/0014 450/34
2006/0150302 A1 * 7/2006 Warren ..... A41B 9/001 2/400
2006/0234584 A1 * 10/2006 Valentine ..... A41D 1/002 442/304
2007/0079427 A1 * 4/2007 Herbert ..... A41B 9/00 2/403
2007/0186325 A1 * 8/2007 Torrent Lopez ..... A41B 9/001 2/69
2007/0199134 A1 * 8/2007 Duckman ..... A41B 9/04 2/239
2010/0088803 A1 * 4/2010 Orloff ..... A41D 13/0015 2/228
2010/0107702 A1 * 5/2010 Rad ..... A41B 11/14 66/178 R
2010/0281595 A1 * 11/2010 Gernes ..... A41B 9/001 2/69
2011/0003533 A1 * 1/2011 Caruso ..... A41B 9/06 450/11
2012/0084903 A1 * 4/2012 Roberts ..... A41B 9/02 2/400
2012/0131721 A1 * 5/2012 Conti ..... D04B 1/243 2/69
2012/0222189 A1 * 9/2012 Sokolowski ..... A41D 13/0015 2/69
2013/0254971 A1 * 10/2013 Galluzzo ..... A41D 1/00 2/115
2014/0041102 A1 * 2/2014 Gallagher ..... A41B 9/04 2/406
2014/0273744 A1 * 9/2014 Castellano ..... A41B 9/00 450/156
2015/0011141 A1 * 1/2015 Gasco-Buisson ..... A41C 1/003 450/156
2015/0208733 A1 * 7/2015 James ..... A41B 9/04 450/95
2015/0296894 A1 * 10/2015 Turlan-Van Der Hoeven ..... D04B 1/243 450/97
2015/0320121 A1 * 11/2015 Fligel ..... A41C 1/10 450/155
2016/0073718 A1 * 3/2016 McKinlay ..... A41D 31/00 450/95
2016/0332711 A1 * 11/2016 Harrington ..... A41D 13/0005
2017/0027240 A1 * 2/2017 McClean ..... A41C 1/003

* cited by examiner

SEAMLESSLY TRANSITIONED, DOUBLE LAYER, DUAL FABRIC GARMENT

FIELD OF THE INVENTION

The present invention relates to garments that are made of material comprising two fabrics that are seamlessly attached to each other. More specifically, the present invention relates to garments that have two layers (i.e., two-ply), the first layer comprising natural fibers and the second comprising synthetic fibers, where the first and second layers are seamlessly attached to each other.

BACKGROUND OF THE INVENTION

Young girls and women have worn clothing layers under skirts and dresses for centuries. Health and modesty are the primary reasons for doing so. Underwear actually dates to the 15th century, and the evolution of underwear, as far as women are concerned, has included shifts, petticoats, knickers, pantaloons and bloomers. Original designs were open between the legs, until closed crotch designs were introduced in the early 19th century. In addition to general health and modesty, closed crotch under layers also helped contain menstruation.

Girls and young women today are widely advised by the medical community to wear, at a minimum, underwear with a cotton crotch for better health and hygiene. Cotton is a natural fiber, as such, it is good with respect to the absorption of moisture while, at the same time, it provides good ventilation. Nevertheless, cotton can only hold so much moisture (approximately 7% by weight) and once saturated, it is uncomfortable and unhealthy.

Synthetic athletic shorts and leggings, with and without compression, are highly popular apparel choices for leisure activities as well as athletics. These garments are typically manufactured without cotton crotches and are usually worn with a pair of underwear. However, anyone that has done this knows that underwear worn underneath synthetic athletic shorts is bulky and, therefore, generally uncomfortable. Additionally, wearing underwear underneath synthetic athletic shorts involves two individual and independent garments that are not attached to each other. The underwear thus has a tendency to shift out of place (typically riding up ones buttocks), causing further discomfort and potential chafing. Finally, wearing underwear underneath synthetic athletic shorts results in undesirable panty lines that are visible through the shorts. Choosing not to wear underwear with a synthetic short, pant or legging, especially if it includes spandex/compression, is unhealthy, and can lead to yeast infections, urinary tract infections and unpleasant odor.

In contrast, synthetic shapewear typically incorporates a seamed, sewn-in cotton crotch. Although a sewn-in cotton crotch would eliminate the discomfort associated with the shifting of underwear relative to the synthetic outerwear, a sewn-in cotton crotch does nothing to eliminate undesirable and unsightly panty lines. Moreover, cotton shapewear is still somewhat bulky, the seams themselves can dig into the skin of the person wearing the shapewear, and the cotton often undesirably "sticks" to any outerwear worn over the shapewear. Moreover, sewn-in cotton crotches cover but a small area of the shapewear, offering only a small level of breathability. Consequently, sewn-in cotton crotches do not eliminate the problems otherwise associated with wearing underwear underneath synthetic clothing, such as synthetic athletic shorts and synthetic shapewear. An example of shapewear with seamed, sewn-in crotch can be found in U.S. Pat. No. 7,024,892.

Tumbleshorts are presently popular among young girls and pre-teens. Tumbleshorts are meant to be worn over underwear and underneath skirts and dresses. While the tumbleshorts help to preserve modesty, they are separate and independent garments, and thus result in an additional layer of clothing while eliminating none of the above-identified causes of discomfort.

Accordingly, athletic shorts and/or shapewear that are all-cotton, all-synthetic or synthetic with seamed, sewn-in cotton crotches are the only choices presently on the market. While women and girls today deserve garments that are healthy, comfortable and stylish, none of the current market choices for active wear, including athletic shorts and shapewear, or underwear exhibit all the health, comfort and style benefits into one garment.

SUMMARY OF THE INVENTION

The present invention obviates the aforementioned deficiencies associated with prior art athletic shorts and shapewear, as well as other types of garments. In general, the present invention achieves this by providing a double, attached layer that acts, looks and feels like a single layer garment, where a first inner layer, worn next to the skin, is at least in part made of a natural fiber (e.g., cotton) and a second outer layer is made of a synthetic fiber (e.g., spandex). The two layers, therefore, exhibit different qualities. However, unlike the prior art, the natural fiber inner layer and the synthetic fiber outer layer are seamlessly joined. In at least one exemplary embodiment, they are seamlessly joined so that the garment is one continuous whole garment without any seams. More particularly, the transition from the natural fibers to the synthetic fibers are, at leas in part, seamless. Accordingly, garments in accordance with exemplary embodiments of the present invention offer a natural fiber inner layer on or against the body of the person wearing the garment, and a synthetic outer layer. Either or both sides may or may not also contain multi-directional or targeted zone stretch/compression, moisture wicking and antimicrobial yarns or treatments to further enhance performance properties.

In view of the remarks above, it is an objective of the present invention to provide a garment with a natural fiber (e.g., cotton) inner layer working in tandem with a synthetic outer layer so as to offer the health benefits of moisture absorption and ventilation for maximum dryness and elimination of bacteria and odor associated with bacteria.

It is another object of the present invention to provide a garment that offers the comfort benefits associated with cottony softness and irritation prevention against the skin, and at the same time, the added comfort associated with seam-free knitting, particularly where the natural fibers and synthetic fibers transition from one to the other (e.g., at the waist or leg openings) with the added benefit of zonal compressive attributes.

It is yet another objective of the present invention to provide a garment that offers the above mentioned benefits, and in addition, a garment that does not require a separate and/or independent undergarment that may shift or ride up on the person wearing the garment, causing further discomfort.

It is still another objective of the present invention to provide a garment that is stylish, in that, no visible panty lines are present.

It is still another objective of the present invention to provide a garment that has a supple outer layer that allows skirts and dresses to slide/smooth over it without causing the skirt or dress to stick.

It is still another objective of the present invention to provide a garment that preserves modesty by being somewhat opaque/non-see-through.

In accordance with one aspect of the present invention, the above-identified and other objectives are achieved by a garment that comprises an outer layer made from synthetic fibers and an inner layer made from natural fibers. The garment also comprises a gap between the outer layer and the inner layer, and one or more seamless transition zones, where the inner layer and the outer layer are knitted together without a seam.

In accordance with another aspect of the present invention, the above-identified and other objectives are achieved by a method of manufacturing a garment that comprises an outer layer made from synthetic fibers and an inner layer made from natural fibers, a gap between the outer layer and the inner layer, and one or more seamless transition zones, where the inner layer and the outer layer are knitted together without a seam.

BRIEF DESCRIPTION OF THE DRAWINGS

Several figures are provided herein to further the explanation of the present invention. More specifically.

DETAILED DESCRIPTION

It is to be understood that both the foregoing general description and the following detailed description are exemplary. As such, the descriptions herein are not intended to limit the scope of the present invention. Instead, the scope of the present invention is governed by the appended claims.

Figure 1A:
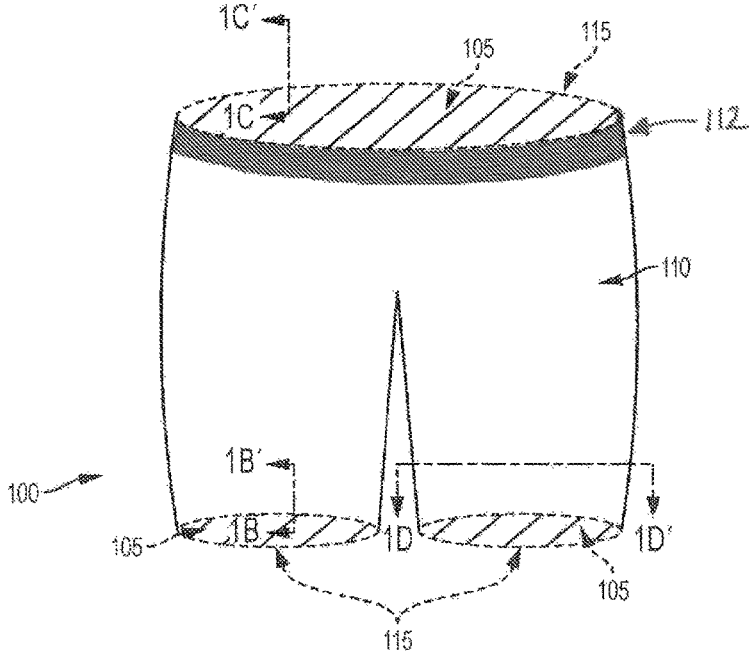
FIGS. 1A-D illustrate a pair of base layer shorts, meant to be worn as an under- or outer garment, in accordance with a first exemplary embodiment of the present invention.
Figure 1B:
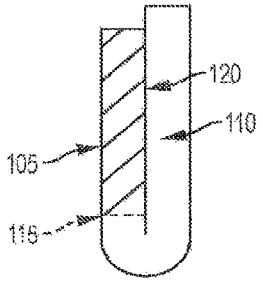
Figure 1C:
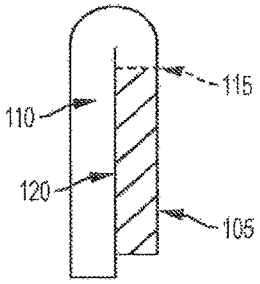
Figure 1D:
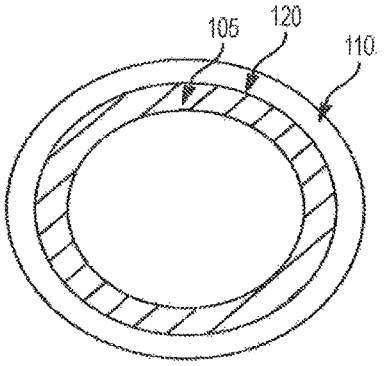

FIGS. 1A-D illustrate a garment 100 in accordance with a first exemplary embodiment of the present invention. Garment 100 happens to be a pair of base layer shorts ("shorty"); however, the present invention is not limited to base layer shorts, as will evident from the disclosure below. More specifically, FIG. 1A is a front view of garment 100. FIG. 1B is a vertical cross-section of garment 100 at the leg opening along line bb'. FIG. 1C is a vertical cross-section of garment 100 at the waist opening along line cc'. And, FIG. 1D is a horizontal cross-section of a leg portion of garment 100 along line dd'.

As illustrated, garment 100 is a double layer garment. The first, inner layer 105 is made from natural fibers (e.g., cotton fibers). The second, outer layer 110 is made from synthetic fibers and, in particular, synthetic compression fibers (e.g., spandex). Thus, the double layer garment 100 is at least a dual fabric garment.

In a preferred embodiment, the inner layer 105 is made from cotton fibers. Although the inner layer 105 may be 100 percent cotton, other types of fibers are incorporated into the cotton fibers, in accordance with the preferred embodiment. These other types of fibers may include spandex fibers, Breeze fibers (made by NILIT®) as well as other types of synthetic and/or other types of fibers. The inner layer 105 is, nevertheless, predominantly made of cotton fibers (e.g., 80-85 percent cotton and 15-20 percent other), as such, the fibers associated with the inner layer 105 will be referred to herein as natural fibers for ease of discussion.

The outer layer 110, as stated above, is made from synthetic fibers which are preferably compressive. Accordingly, the outer layer 110 holds the garment 100, including the inner layer 105, firmly in place against the body of the person wearing garment 100. Although it is not illustrated in FIGS. 1A-D, the outer layer 100 may include one or more compression zones, for example, around the waist opening and/or around the leg openings. For purposes of illustration, see compression zone 112 in FIG. 1A. These compression zones would include a greater number of synthetic fibers which results in an increase in the degree of compression in these zones, thereby causing the corresponding portions of garment 100 to rest even more firmly against the body of the person wearing garment 100.

Garment 100 also includes transition zones 115. The transition zones 115 represent a transition between the natural fibers of the inner layer 105 and the synthetic fibers of the outer layer 110. In accordance with the present invention, the transition zones are seamless. In other words, the natural fibers of the inner layer 105 and the synthetic fibers of the outer layer 110 are knitted together without a seam. In garment 100, there are seamless transition zones 115 around the waist opening and each of the leg openings, as shown. Seamless knitting is a known technique, and there are currently many seamless knitting machines on the market. Santoni is one example of a well-known manufacturer of seamless knitting machines.

Further in accordance with the embodiment illustrated in FIGS. 1A-D, there is a gap (or spacing) 120 between the outward facing side of inner layer 105 and the inward facing side of outer layer 110. For all practical purposes, however, the gap 120 is negligible, particularly when garment 100 is worn, as the outer layer 110 compresses the inner layer 105 against the body of the person wearing garment 100, so as to essentially eliminate gap 120.

Still further in accordance with the embodiment of FIGS. 1A-D, the outer layer 110 wraps around and under itself, adjacent to each of the seamless transition zones 115, such that the first fabric is a continuous fabric that comprises the first portion of the inner layer 105 and at least the majority of the outer layer 110. This is best illustrated in FIGS. 1B and 1C. The purpose of this is at least two-fold. First, it improves the aesthetics of garment 100 by making the edges of garment 100 around the waist opening and the leg openings appear more finished and clean. Second, it improves the functionality of garment 100 by providing additional compression at the waist and leg openings. As one skilled in the art will readily appreciate, cotton has a tendency to sag when saturated. However, this additional compression below the cotton fibers at the leg openings will help to prevent any sagging.

As described above, and as illustrated in FIGS. 1A-D, garment 100 comprises a plurality of different portions. For example, the outer layer 110 constitutes one portion and the inner layer 105 constitutes another portion. With reference to FIGS. 1B and 1C, it can be seen that the inner layer 105, in accordance with a preferred embodiment, includes at least two sub-portions. The first sub-portion of the inner layer 105 is essentially an extension of the outer layer 110, where the outer layer wraps under itself adjacent to each of the seamless transition zones 115, as explained above and as illustrated in the figures. The cross-hatched sub-portion illustrated in FIGS. 1A-D constitutes a second sub-portion of inner layer 105. Still further, it was explained above that the outer layer 110 and/or the inner layer 105 may include one or more compression zones, which include synthetic fibers or an increased number of synthetic fibers. These compression zones may also constitute distinct portions of garment 100.

FIGS. 2A-D illustrate a garment 200 in accordance with an alternative to the first exemplary embodiment described above. Like garment 100, garment 200 is a pair of base layer shorts which has an inner layer 205 made from natural fibers, preferably cotton fibers, and an outer layer 210 made from synthetic fibers, for example, spandex. Like garment 100, garment 200 has seamless transition zones 215 around the leg openings. There is also a gap 220 between the outward facing side of inner layer 205 and the inward facing side of outer layer 210. The outer layer 210 may comprise one or more compression zones. However, unlike garment 100, the inner layer 205 and the outer layer 210 of garment 200 are attached by a seam 225 around the waist opening for an even more secure fit.

Figure 2A:
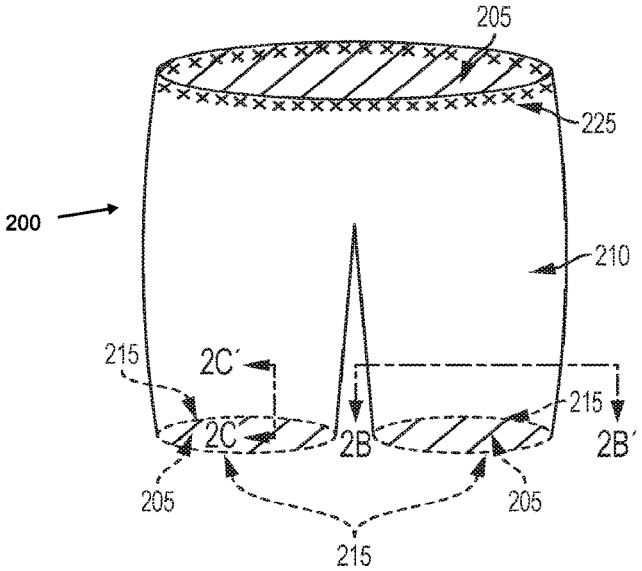
FIGS. 2A-D illustrate a pair of base layer shorts in accordance with an alternative to the first exemplary embodiment of the present invention.

FIG. 2A specifically illustrates a front view of garment 200. From the front view, the seam 225 is more evident. In contrast, there are seamless transition zones 215 around the leg openings.

Figure 2B:
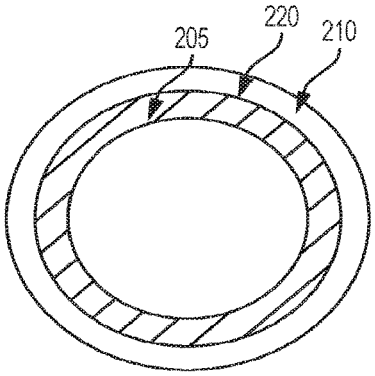

FIG. 2B is a horizontal cross-section of the right leg portion of garment 200 along line bb'. FIG. 2B more clearly illustrates the relative position of the outer layer 210 compared to the inner layer 205, and how the gap 220 is in essence negligible, particularly when the garment 200 is worn and the outer layer 210 compresses the gap 220 and the inner layer 205 against the body of the person wearing garment 200.

Figure 2C:
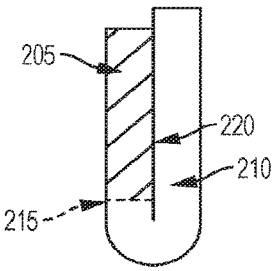

FIG. 2C is a vertical cross-section of garment 200 at the leg opening along line cc'. It is evident from FIG. 2C that the outer layer 210 wraps around and under itself just below and adjacent to the corresponding transition zone 215, like outer layer 110 of garment 100.

Figure 2D:
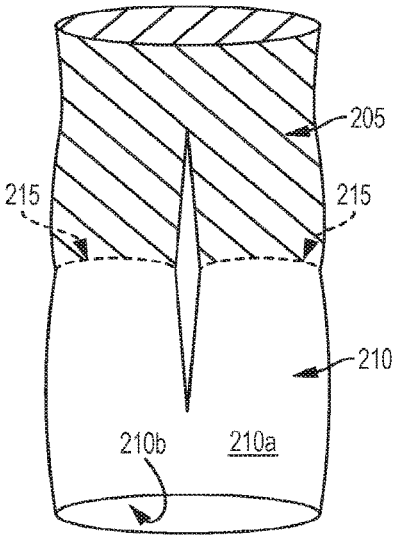

FIG. 2D illustrates the inner layer 205 and the outer layer 210 of garment 200 as it may appear after an initial phase of the manufacturing process. What appears to be the outward facing side of outer layer 210 is actually the inward facing side 210*a*, and what appears to be the inward facing side of outer layer 210 is actually the outward facing side 210*b*. To complete the manufacturing process, the waist portion of outer layer 210 would have to be pulled up and over the inner layer 205 (in the direction of arrows A) so that the outward facing side 210*b* of the outer layer 210 is, in fact, facing outward. The waist portion of the outer layer 210 and the waist portion of the inner layer 2015 would then be connected by seam 225 (see FIG. 2A).

Figure 3A:
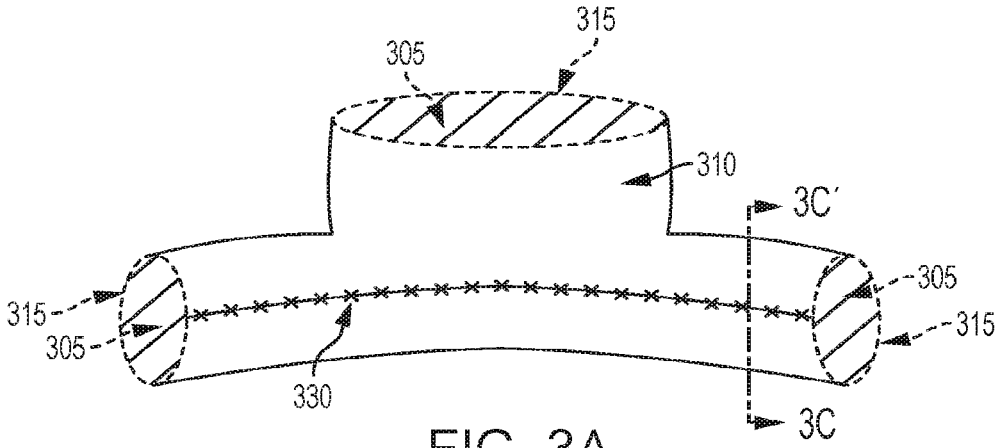
FIGS. 3A-C illustrate a pair of base layer shorts in accordance with another alternative to the first exemplary embodiment of the present invention.
Figure 3B:
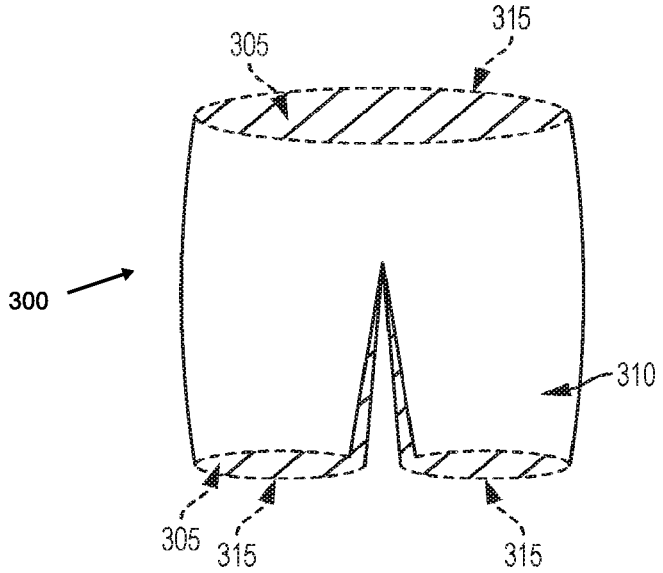
Figure 3C:
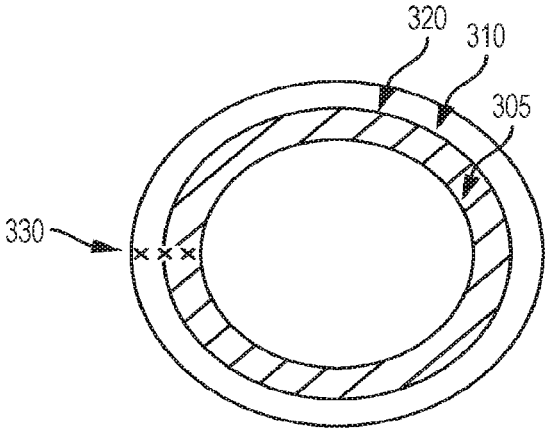

FIGS. 3A-C illustrate a garment 300 in accordance with another alternative to the first exemplary embodiment described above. Like garment 100, garment 300 is also a pair of base layer shorts which has an inner layer 305 made from natural fibers, preferably cotton fibers, and an outer layer 310 made from synthetic fibers, for example, spandex. Like garment 100, garment 300 has seamless transition zones 215 at least around the leg openings. There may also be a seamless transition zone 215 around the waist opening, like garment 100. Alternatively, there may be a seam around the waist opening of garment 300, like garment 200. In addition, there is a gap 320 between the inner layer 305 and the outer layer 310, and the outer layer 310 may comprise one or more compression zones. However, unlike garment 100 and unlike garment 200, there is a seam 330 that traverses garment 300 from one leg opening to the other leg opening running along the inner thighs and under the crotch. Reduced cost and ease of manufacturing may be the primary reason for manufacturing a shorty in accordance with the present invention as shown in FIGS. 3A-C.

FIG. 3A specifically illustrates a front view of garment 300 with the leg portions spread out so as to better illustrate the positioning of seam 330. FIG. 3B is also a front view of garment 300, however, this is how garment 300 may appear after an initial phase of the manufacturing process and prior to the incorporation of seam 330. FIG. 3C is similar to FIGS. 1D and 2B in that it is a cross-section of a leg portion of garment 300. In addition to illustrating the relative position of inner layer 305, outer layer 310 and gap 320, FIG. 3C also illustrates the positioning of seam 330.

Figure 4A:
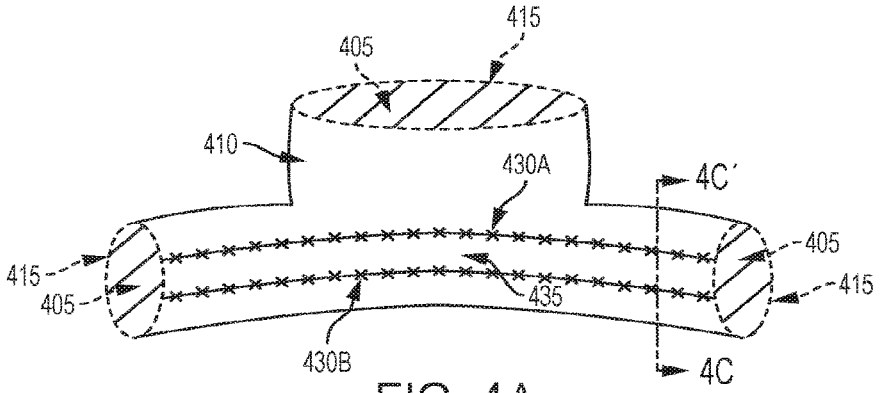
FIGS. 4A-D illustrate a pair of base layer shorts in accordance with still another alternative to the first exemplary embodiment of the present invention.
Figure 4B:
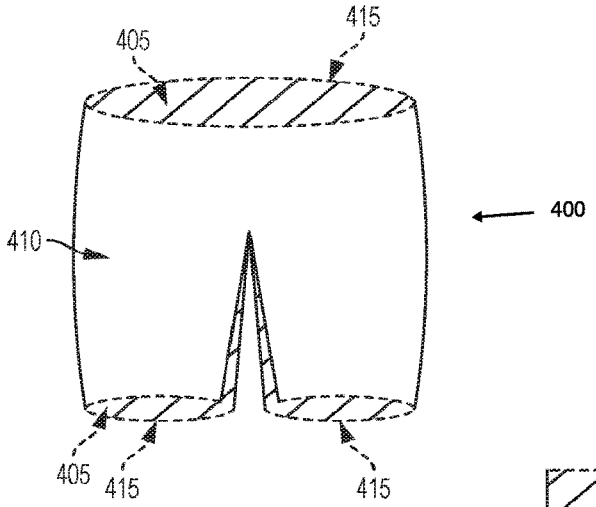
Figure 4C:
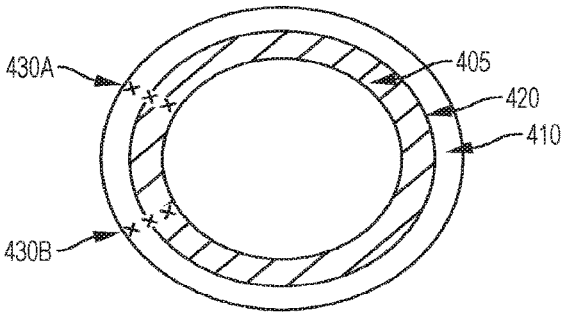

FIGS. 4A-D illustrate a garment 400 in accordance with yet another alternative to the first exemplary embodiment described above. Like garment 100, garment 400 is also a pair of base layer shorts which has an inner layer 405 made from natural fibers, preferably cotton fibers, and an outer layer 410 made from synthetic fibers, for example, spandex. Like garment 100, garment 400 has seamless transition zones 415 at least around the leg openings and along the two arch-shaped edges that traverse garment 400 from one leg opening to the other and under the crotch, as best illustrated in FIG. 4B. There may also be a seamless transition zone 415 around the waist opening, like garment 100. Alternatively, there may be a seam around the waist opening of garment 400, like garment 200. In addition, there is a gap 420 between the inner layer 405 and the outer layer 410, and the outer layer 410 may comprise one or more compression zones.

However, unlike garments 100, 200 and 300, there are two seams 430A and 430B that traverse garment 400 from one leg opening to the other leg opening running along the inner thighs and under the crotch. The purpose of seams 430A and 430B is to fasten in place a crotch portion or panel 435, illustrated in FIG. 4C, which is described in greater detail herein below.

Figure 4D:
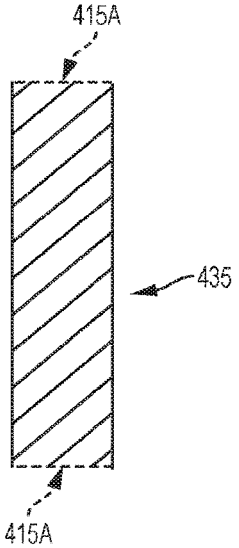

As stated, FIG. 4D illustrates the crotch panel 435. Crotch panel 435, in accordance with this alternative embodiment, is fastened to and becomes a part of garment 400, as illustrated in FIG. 4A, by seams 430A and 430B. FIG. 4D further illustrates crotch panel 435 with the natural fiber inner layer 405A face-up. Thus, it will be understood that the opposite side of crotch panel 435 is the outer layer 410A, although it is not visible in FIG. 4D. Additionally, what appears in FIG. 4D as the top and bottom edges of crotch panel 435 include seamless transition zones 415A. The seamless transition zones 415A of crotch panel 435 will line up with the seamless transition zones 415 around the leg openings of garment 400 when crotch panel 435 is fastened in place.

One advantage of this alternative embodiment may be ease of manufacture, particularly if the inner layer 405A of the crotch panel 435 comprises a different natural fiber composition than the remaining portion of inner layer 405 of garment 400. As mentioned above, the natural fibers of the inner layer may incorporate other types of fibers, including synthetic fibers. The percentage of natural fibers, such as cotton fibers, compared to other fibers, may affect the performance of the inner layer and the garment as a whole. For example, if greater moisture absorption in the crotch area is desired, the percentage of cotton fibers compare to synthetic fibers may be increased. It is also conceivable that the inner layer 405A of crotch panel 435 incorporates anti-microbial fibers or is otherwise chemically treated to help control odor.

It should be noted, the natural fiber composition of the inner layer in the crotch area could be different than the composition of the remaining portion of the inner layer even without the use of seams, if seamless manufacturing techniques are used to manufacture garment 400. In other words, seams 430A and 430B are simply optional, and garment 400 is still considered seamless given the various seamless transition zones 415 and 415A.

FIG. 4A specifically illustrates a front view of garment 400 with the leg portions spread out so as to better illustrate the positioning of seams 430A and 430B. FIG. 4D is similar to FIGS. 1D, 2B and 3C in that it is a cross-section of a leg portion of garment 400. In addition to illustrating the relative position of inner layer 405, outer layer 410 and gap 420, it also helps illustrate the positioning of seams 430A and 430B.

Figure 5:
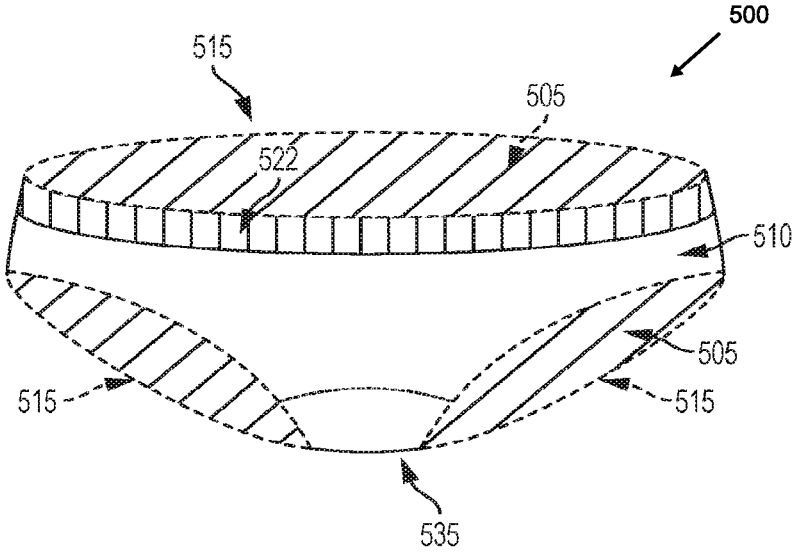
FIG. 5 illustrates a pair of underwear in accordance with a second exemplary embodiment of the present invention.

FIG. 5 illustrates a garment 500 in accordance with a second exemplary embodiment of the present invention. Garment 500 is a pair of underwear, further emphasizing that the present invention is not limited to a pair of base layer shorts or any other particular garment. Like garments 100-400 described above, garment 500 has an inner layer 505 made from natural fibers, preferably cotton fibers, and an outer layer 510 made from synthetic fibers, for example, spandex. Like garments 100-400, garment 500 has seamless transition zones 515 at least around the leg openings. There is also a gap (not shown) between the inner layer 505 and the outer layer 510, and the outer layer 510 may comprise one or more compression zones, for example, compression zone 522 around the waist to provide added compression to help hold the underwear in place. Alternative, garment 500 may include a seam at the waist opening (not shown), like garment 200 described above.

As garment 500 is underwear, there are some differences compared to garments 100-400. First, there are no leg portions. Nevertheless, the leg openings of garment 500 may be the same or at least substantially the same as garments 100-400 in that outer layer 510 may wrap under itself adjacent to the seamless transition zones 515, as illustrated, for example, in FIGS. 1B and 2C. Second, both the inner layer 505 and the outer layer 510 are likely to be more lightweight and sheer in comparison to garments 100-400. Unlike garments 100-400, opacity is less of an issue with underwear.

As described above with respect to garment 400, the inner layer 505 of garment 500 may comprise a crotch portion or panel 535. Further, the inner layer of crotch portion 535 may be different than the remaining portion of inner layer 505. For example, the inner layer of crotch portion 535 may be different chemically, wherein the different chemical constituency may help to control odor. Alternatively, or in addition, the crotch portion may comprise different yarn than the remaining portion of the inner layer 505, for example, the natural fibers may incorporate other fibers including anti-microbial fibers, again to help control odor. If not different yarn, then possibly different percentages of the same yarn. As explained above, more natural fibers, such as cotton fibers, compared to synthetic fibers may increase the crotch portion's ability to absorb moisture. Finally, the crotch portion 535 may be seamlessly incorporated into the remaining portion of the inner layer 505 or it may be manufactured separately with an inner layer and a corresponding outer layer, and attached to the underwear much the same way crotch panel 435 was attached to garment 400 by seams 430A and 430B. The dashed line 530 in FIG. 5 illustrates the general position of any seams that may be used to attach crotch panel 535 if it is manufactured separately.

Figure 6A:
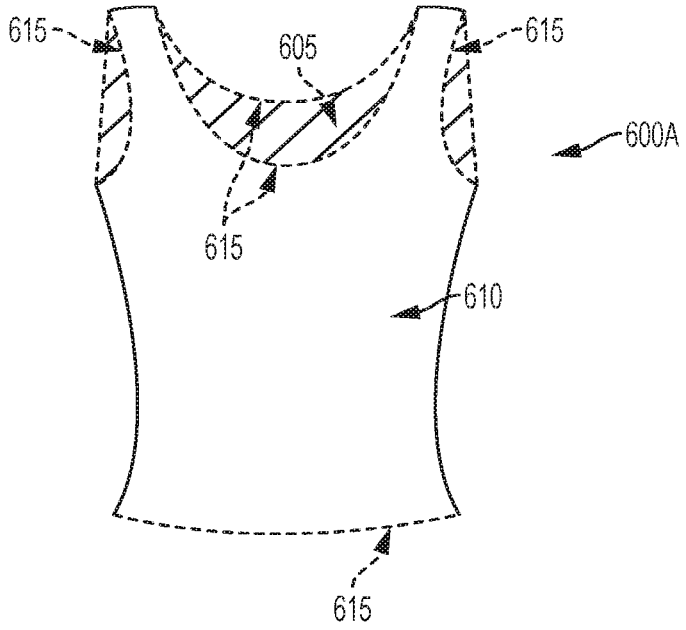
FIGS. 6A-B illustrate tank tops in accordance with a third exemplary embodiment of the present invention.
Figure 6B:
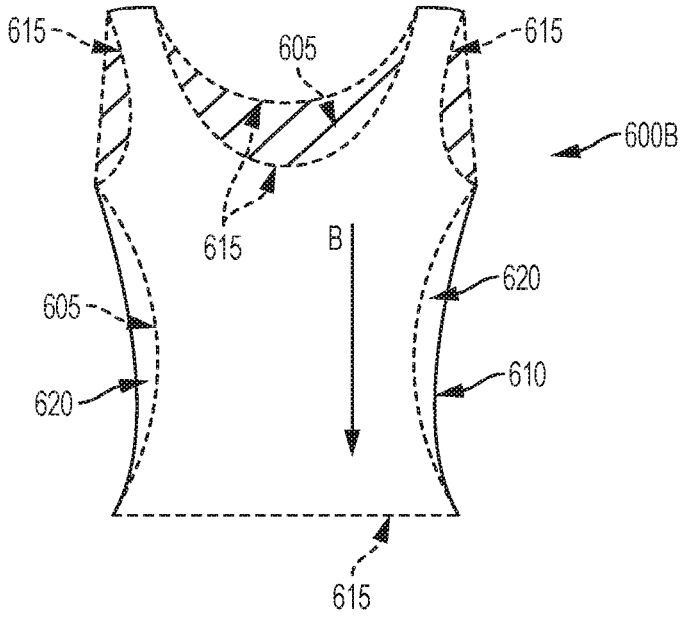

FIGS. 6A and 6B illustrate garments 600A and 600B, respectively, in accordance with a third exemplary embodiment of the present invention. Garments 600A and 600B are tank tops, even further emphasizing the fact that the present invention is not limited to any specific type of garment, such as a shorty or underwear. Like the garments described above, garments 600A and 600B have an inner layer 605 made from natural fibers, preferably cotton fibers, and an outer layer 610 made from synthetic fibers, for example, spandex. Like the garments described above, garments 600A and 600B have seamless transition zones 615. In the case of a tank top, the transition zones may be positioned around the arm openings, neck opening and the waist opening, as illustrated. And, like the other garments described above, there is a gap 620 between the inner layer 605 and the outer layer 610, and the outer layer 510 may comprise one or more compression zones. The gap 620 is accentuated in FIG. 6B, which will be described in greater detail herein below.

The tank top of FIG. 6B does differ from the tank top of FIG. 6A. The inner layer 605 of garment 600B comprises a sufficient number of synthetic fibers so that the inner layer 605 exerts a greater degree of compression than does the outer layer 610. Thus, the gap 620 is noticeable in garment 600B, more so than any of the other garments discussed above. A tank top such as garment 600B may be desirable if the person wearing the garment wants a greater degree of support against their body and, possibly, a looser fitting outer layer. The inner layer 605 of garment 600B may comprise different compression zones in locations where a greater degree of support is most likely desirable, such as, in the abdominal area and around the bust. Alternatively, the degree of compression exhibited by the inner layer 605 of garment 600B may gradually decrease from top to bottom, in the direction of arrow B in FIG. 6B.

Although neither garment 600A or 600B was described as comprising any seams, one or more seams might be incorporated into the garment, as was the case with both the shorty and the underwear described above. For example, it is conceivable that a seam might be desirable around the neck opening.

Finally, while FIGS. 6A and 6B illustrate garments that happen to be tank tops, one skilled in the art will appreciate the that tops with sleeves, including short or longer sleeves, could be manufactured in accordance with exemplary embodiments of the present invention. Like the other garments described above, these tops would also have an inner layer that is made of natural fibers, an outer layer that is made of synthetic fibers and one or more seamless transition zones. Like the tank tops illustrated in FIGS. 6A and 6B, tops with sleeves could be completely seamless or incorporate some seams as desired, for example, around the neck opening, or possibly, where the sleeves attach to the remaining portion of the garment.

From the detailed description above, it should be clear to one skilled in the art that the present invention is not, as stated, limited to athletic shorts ("shorties), or underwear or tops, including tank tops and tops with sleeves. In fact, many other types of garments could conceivably take advantage of the present invention, such as socks (including compression socks), hats, gloves (mittens) and running sleeves, to name just a few. Additionally, the scope of the present invention is not limited to garments themselves; it is intended to also cover any method or process of manufacturing any garments covered by the exemplary embodiments of the present invention.

What is claim is:

1. A garment comprising:

an outer layer, wherein at least a majority of the outer layer comprises a first fabric;

an inner layer comprising a first portion and a second portion;

a gap between said outer layer and said inner layer, wherein the first fabric of the outer layer is folded inward at each of one or more openings in the garment to form the first portion of the inner layer, such that the first portion of the inner layer and at least the majority of the outer layer are the same continuous first fabric without any joining between the first portion of the inner layer and the outer layer, and wherein the second portion of the inner layer comprises a second fabric, the second portion of the inner layer making up a majority of the inner layer; and a seamless transition zone on the inner layer where, at each of the one or more openings, the first portion of the inner layer comprising the first fabric and the second portion of the inner layer comprising the second fabric are seamlessly joined.

2. The garment of claim 1, wherein the one or more openings comprise first and second leg openings.

3. The garment of claim 2, wherein the garment is underwear.

4. The garment of claim 3, wherein the outer layer is not opaque.

5. The garment of claim 2, wherein the garment is a shorty.

6. The garment of claim 2 further comprising a single piece, double layer crotch portion that includes:

an outer crotch layer comprising the first fabric;

an inner crotch layer that has a natural fiber composition; and a gap between the outer crotch layer and the inner crotch layer, wherein an edge portion of the outer crotch layer is fastened to an edge portion of the inner crotch layer, and wherein the crotch portion is fastened to the garment such that the outer crotch and inner crotch layers of the crotch portion align with the outer and inner layers of the garment, respectively.

7. The garment of claim 6, wherein the constituency of the inner crotch layer is different than the constituency of the inner layer of a remaining portion of the garment.

8. The garment of claim 6, wherein the crotch portion attaches to the remaining portion of the garment by at least two seams.

9. The garment of claim 6, wherein the crotch portion is further fastened to the garment along two seams that run from the first leg opening to the second leg opening.

10. The garment of claim 9, wherein the two seams run parallel to each other.

11. The garment of claim 1, wherein the one or more openings in the garment comprise a waist opening.

12. The garment of claim 11 wherein said outer layer further comprises at least one compression zone.

13. The garment of claim 12, wherein the at least one compression zone is located around the waist opening.

14. The garment of claim 1 further comprising a waist opening and a seam around the waist opening.

15. The garment of claim 1 wherein the one or more openings is selected from a group consisting of at least one of a neck opening, a waist opening, first and second arm openings, and first and second leg openings.

16. The garment of claim 15, wherein the inner layer comprises cotton fibers and synthetic fibers and one or more compression zones.

17. The garment of claim 1 wherein the one or more openings comprises a neck opening, a waist opening, and first and second arm openings.

18. The garment of claim 1, wherein the outer layer, including the first fabric, and the first portion of the inner layer are exclusively made from synthetic fibers, and wherein the second portion of the inner layer, including the second fabric, is made from fibers, at least the majority of which are natural fibers.

19. The garment of claim 18, wherein the synthetic fibers are elastic fibers.

20. The garment of claim 19, wherein the synthetic elastic fibers are spandex fibers.

21. The garment of claim 18, wherein the natural fibers are cotton fibers.

22. The garment of claim 21, wherein the second portion of the inner layer includes synthetic fibers.

23. A method of manufacturing a garment, the method comprising:

generating an outer layer, wherein at least a majority of the outer layer comprises a first fabric;

generating an inner layer comprising a first portion and a second portion;

arranging the outer layer and the inner layer so there is a gap between said outer layer and said inner layer, wherein generating the inner layer comprises:

folding the first fabric of the outer layer inward at each of one or more openings in the garment to form the first portion of the inner layer, such that the first portion of the inner layer and at least the majority of the outer layer are the same continuous first fabric without any joining between the first portion of the inner layer and the outer layer, and seamlessly joining, at each of the one or more openings, the first portion of the inner layer comprising the first fabric and the second portion of the inner layer, wherein the second portion of the inner layer comprises a second fabric; and wherein the second portion of the inner layer makes up a majority of the inner layer.

* * * * *